US009048595B2

(12) United States Patent
Fathauer

(10) Patent No.: US 9,048,595 B2
(45) Date of Patent: Jun. 2, 2015

(54) RETAINING CLIP FOR ELECTRICAL CONNECTORS

(71) Applicant: Advanced Powertrain Engineering, LLC, Sullivan, IN (US)

(72) Inventor: Paul Fathauer, Sullivan, IN (US)

(73) Assignee: Advanced Powertrain Engineering, LLC, Sullivan, IN (US)

( * ) Notice: Subject to any disclaimer, the term of this patent is extended or adjusted under 35 U.S.C. 154(b) by 89 days.

(21) Appl. No.: 13/848,513

(22) Filed: Mar. 21, 2013

(65) Prior Publication Data

US 2013/0252460 A1 Sep. 26, 2013

Related U.S. Application Data

(60) Provisional application No. 61/613,808, filed on Mar. 21, 2012, provisional application No. 61/751,147, filed on Jan. 10, 2013, provisional application No. 61/789,381, filed on Mar. 15, 2013.

(51) Int. Cl.

| | |
|---|---|
| ***H01R 13/60*** | (2006.01) |
| ***H01R 13/73*** | (2006.01) |
| ***H01R 43/027*** | (2006.01) |
| ***H01R 13/639*** | (2006.01) |
| *H01R 43/00* | (2006.01) |

(52) U.S. Cl.

CPC ..... *H01R 13/73* (2013.01); *H01R 43/027* (2013.01); *H01R 13/6395* (2013.01); *H01R 43/002* (2013.01)

(58) Field of Classification Search

CPC ..... H01R 13/74; H01R 13/748; H01R 13/64; H01R 13/6315; H01R 13/639; H01R 13/62; H01R 13/6275; H01R 31/06

USPC ..... 439/533, 350–358, 369

See application file for complete search history.

(56) References Cited

U.S. PATENT DOCUMENTS

| | | | |
|---|---|---|---|
| 1,310,627 | A | 7/1919 | McEvilly |
| 2,406,567 | A | 8/1946 | Schueneman |
| 2,720,633 | A | 10/1955 | Westberg |
| 2,753,536 | A | 7/1956 | Tjader |
| 2,761,109 | A | 8/1956 | Hacker |
| 3,030,601 | A | 4/1962 | Kress |
| 3,183,470 | A | 5/1965 | Hale |
| 3,383,639 | A | 5/1968 | Anderson et al. |
| 3,475,716 | A | 10/1969 | Laig |
| 3,609,638 | A | 9/1971 | Darrey |
| 3,824,525 | A | 7/1974 | Keller |
| 3,881,753 | A | 5/1975 | Bochory |

(Continued)

FOREIGN PATENT DOCUMENTS

| | | |
|---|---|---|
| GB | 2257572 | 1/1993 |
| WO | 2007012134 | 2/2007 |

*Primary Examiner* — Xuong Chung Trans

(74) *Attorney, Agent, or Firm* — John V. Daniluck; Keith J. Swedo; Bingham Greenebaum Doll LLP

(57) ABSTRACT

A retaining clip that provides a method for securing electrical connections between a male and female electrical connectors is disclosed. Current locking mechanisms are on both the electrical plug and the connector. These locking mechanisms often break when disconnecting the plug. Some embodiments of the present invention eliminate the need for the locking mechanisms. Furthermore, in cases where the mechanisms have been broken, some embodiments provide a method for reusing the electrical plug and/or the connector.

16 Claims, 11 Drawing Sheets

(56) References Cited

U.S. PATENT DOCUMENTS

| | | | | |
|---|---|---|---|---|
| 3,926,497 | A | 12/1975 | Eigenbrode | |
| D244,612 | S | 6/1977 | Burns | |
| 4,076,204 | A | 2/1978 | Kalka | |
| 4,183,603 | A | 1/1980 | Donarummo | |
| 4,221,449 | A | 9/1980 | Shugart, Jr. | |
| D269,065 | S | 5/1983 | Hough, Jr. | |
| D283,441 | S | 4/1986 | Vcelka et al. | |
| 4,690,476 | A | 9/1987 | Morgenrath | |
| 4,773,874 | A | 9/1988 | Kopeski, Jr. | |
| 4,826,486 | A | 5/1989 | Palsrok et al. | |
| 4,832,618 | A | 5/1989 | Gunderson | |
| D302,304 | S | 7/1989 | Kulle et al. | |
| 4,925,399 | A | 5/1990 | Bosworth et al. | |
| 4,940,423 | A * | 7/1990 | Aihara et al. | 439/369 |
| D315,719 | S | 3/1991 | Cusumano et al. | |
| 4,997,421 | A | 3/1991 | Palsrok et al. | |
| 5,129,839 | A | 7/1992 | VanSkiver | |
| 5,174,023 | A | 12/1992 | Kilsdonk | |
| 5,179,044 | A | 1/1993 | Muromachi et al. | |
| 5,211,573 | A | 5/1993 | Cross | |
| 5,445,528 | A | 8/1995 | Frantz | |
| 5,551,888 | A | 9/1996 | Rhodes, Sr. | |
| 5,573,420 | A | 11/1996 | Grosswendt | |
| D393,862 | S | 4/1998 | McInnes | |
| 5,769,646 | A | 6/1998 | Cavello et al. | |
| 5,839,920 | A | 11/1998 | Yurko et al. | |
| 6,036,525 | A | 3/2000 | Alfis, III | |
| 6,050,844 | A | 4/2000 | Johnson | |
| 6,171,146 | B1 | 1/2001 | Fink et al. | |
| 6,254,048 | B1 * | 7/2001 | Ashley et al. | 248/300 |
| 6,257,924 | B1 | 7/2001 | Lund et al. | |
| 6,350,151 | B1 | 2/2002 | Elliot et al. | |
| 6,435,891 | B1 | 8/2002 | Beck, Jr. et al. | |
| 6,500,027 | B1 | 12/2002 | Van Der Sanden et al. | |
| D474,156 | S | 5/2003 | Vournou | |
| 6,790,060 | B1 | 9/2004 | Chiang | |
| 6,905,353 | B2 | 6/2005 | Ma et al. | |
| 7,101,215 | B2 * | 9/2006 | Woellner et al. | 439/371 |
| 7,354,297 | B2 * | 4/2008 | Tsukashima et al. | 439/449 |
| 7,407,405 | B1 | 8/2008 | Slenczka | |
| 7,443,661 | B2 | 10/2008 | Xu et al. | |
| 7,495,900 | B2 | 2/2009 | Shi et al. | |
| D593,037 | S | 5/2009 | Shien-Tang | |
| 7,628,615 | B2 | 12/2009 | Lin et al. | |
| 7,804,691 | B1 | 9/2010 | Davis | |
| 7,922,534 | B2 | 4/2011 | Lin et al. | |
| 8,100,698 | B2 | 1/2012 | Zhu | |
| 2001/0046813 | A1 | 11/2001 | Greenside et al. | |

* cited by examiner

SECTION A-A

RETAINING CLIP FOR ELECTRICAL CONNECTORS

CROSS REFERENCE TO RELATED APPLICATION

This application claims the benefit of priority to U.S. Provisional Patent Application Ser. No. 61/613,808, filed Mar. 21, 2012; U.S. Provisional Patent Application Ser. No. 61/751,147, filed Jan. 10, 2013; and U.S. Provisional Patent Application Ser. No. 61/789,381, filed Mar. 15, 2013, incorporated herein by reference.

FIELD OF THE INVENTION

The present invention relates to apparatus and methods for retaining together assembled electrical connectors, and in some applications to electrical connectors within an automatic transmission.

BACKGROUND OF INVENTION

Automatic transmissions are expensive assemblies that include many long-lasting components. However, there are internal components subjected to levels of vibration, temperature, and other stresses that result in component failure or wear while many of the drivetrain components are in usable condition. In particular, automatic transmissions include one or more solenoid assemblies that operate by command of an electronic controller. These solenoid assemblies often have multipiece electrical connectors that provide power to actuate the solenoid and thereby operate the transmission. However, these solenoids can encounter wear or breakage of the electrical connectors that result in unreliable operation of the transmission, or complete failure to operate. Typically, these connectors are replaced, with the subsequent expenses of procuring new connectors and rebuilding portions of the solenoid assembly to incorporate the new connectors.

The Aisin Warner 55-50 (AW 55-50) transmission is a 5-speed automatic transaxle that is used by several automakers in front wheel and all-wheel drive vehicles. The AW55-50 is a computer controlled transmission that requires interaction between the computer and various sensors and solenoids. The sensors provide feedback to the computer in governing the shift strategy of the transmission. The solenoids are consequently controlled by the computer in order to command certain responses from the transmission. In the case of the AW 55-50, the solenoids are contained within the front control valve body (see FIG. 1). There are five solenoids (shift solenoids) that have two discrete states—on or off. There are an additional three solenoids (linear pressure solenoids) that have infinite states that range between full off and full on. These eight solenoids are all connected to the computer via a variety of wiring harnesses. A typical connection between the linear pressure solenoids and the wiring harness is shown in FIG. 2. In FIG. 2, the plastic male plug 1 from the wiring harness mates into the plastic female connector 2 on the linear pressure solenoid. The interlocking of the connection 3 can be seen in FIGS. 2 and 3 as well.

The locking features on the male plug and female connector can be further identified in FIG. 3. The male plug has a one-way tapered protrusion 4 extending beyond the top plane of the plug. The female connector on the linear pressure solenoid has a bridging feature 5 that intersects the protrusion 4 of the plug. During the engagement, the tapered edge of the protrusion pushes up the bridge allowing the plug to be inserted fully. However, the back edge of the protrusion mates flatly against the bridge 3 and therefore the plug cannot be easily removed.

The locking feature prevents servicing of the linear pressure solenoids without breaking the bridging feature on the connector. A service technician may try to insert a small screwdriver under the bridge as shown in FIG. 4. However, this often is ineffective because the amount of deflection required often breaks the bridge or permanently deforms the bridge. This renders the locking mechanism useless if the linear pressure solenoid is reused. Also, a service technician may just cut the bridge off the connector as shown in FIG. 5. Again, this prevents the plug from being secured in the connector if the linear pressure solenoid is reused.

Various embodiments of the present invention pertain to methods and apparatus to improve the repairability of used automatic transmissions.

SUMMARY OF THE INVENTION

It is preferred that a method for securing such a connection be utilized that allows for servicing. Herein are described various embodiments of a reusable retaining clip that provide several useful aspects. Some allow for robustly securing electrical connections such as described in the AW 55-50. Other embodiments are reusable and therefore allow technicians to disengage the plug from the connector with ease. Yet other embodiments allow an effective "fix" for reusing connectors that have been broken. This permits the reuse of the connectors. In the case of the AW 55-50, as but one example, this feature enables the technician to reuse linear pressure solenoids that otherwise would be unusable.

One aspect of the present invention pertains to a method for repairing an electrical connector. Some embodiments include providing a used connector assembly having a first electrical connector, the second electrical connector, of an electrical wiring harness, and a retaining clip. Other embodiments include placing the clip over the mated first connector and second connector. Yet other embodiments include securing the placed clip to the mated first connector and second connector. Still other embodiments include compressing together the mated first connector and second connector with the secured clip.

Another aspect of the present invention pertains to an apparatus for an assembled multipiece electrical connector. Some embodiments include a one piece body having a top wall and a pair of downwardly depending side walls, the body being fabricated from a resilient material, the side walls being elastically expandable in a direction from a free state to an expanded state, the distance between the inner faces of the body side walls in the free state being about the same or less than the corresponding external distance in the direction between opposing external sides of the assembled connector. The body includes a removal feature useful for elastically expanding the side walls in the direction.

Yet another aspect of the present invention pertains to an apparatus for an assembled multipiece electrical connector. Some embodiments include a one piece body having a top wall. Other embodiments include a lateral wall downwardly depending from one of the lateral sides of the top wall, and an end wall each downwardly depending from the top wall, the lateral wall being elastically expandable in a lateral direction from a free state to an installed state. The body lateral wall in the free state being adapted and configured to fit over on opposing external sides of the assembled connector in the installed state, the height of the end wall being adapted and configured to limit end to end movement of the assembled connector relative to said body when installed.

Still another aspect of the present invention pertains to a method for repairing an automatic transmission. Some embodiments include providing a used solenoid assembly having a first electrical connector mateable with the second electrical connector of an electrical wiring harness, and a retaining clip. Other embodiments include placing the clip over the unmated first connector and second connector, and mating the first connector and second connector having the placed clip. Still other embodiments include securing the placed clip to the mated first connector and second connector. Yet other embodiments include compressing together the mated first connector and second connector with the secured clip.

It will be appreciated that the various apparatus and methods described in this summary section, as well as elsewhere in this application, can be expressed as a large number of different combinations and subcombinations. All such useful, novel, and inventive combinations and subcombinations are contemplated herein, it being recognized that the explicit expression of each of these combinations is unnecessary.

BRIEF DESCRIPTION OF THE DRAWINGS

Some of the figures shown herein may include dimensions. Further, some of the figures shown herein may have been created from scaled drawings or from photographs that are scalable. It is understood that such dimensions, or the relative scaling within a figure, are by way of example, and not to be construed as limiting.

DESCRIPTION OF THE PREFERRED EMBODIMENT

Figure 1:
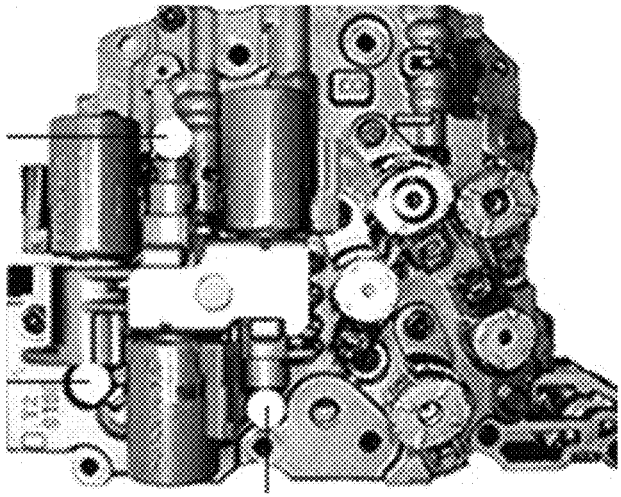
FIG. 1 is a photograph of an Aisin Warner 55-50 front control valve body.
Figure 2:
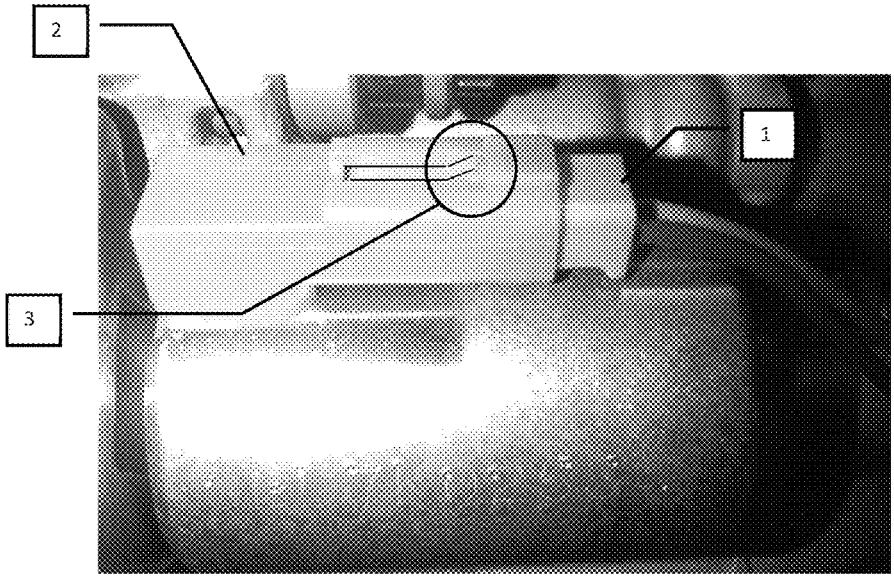
FIG. 2 is a photograph showing a typical engaged connection between linear pressure solenoid and wiring harness.
Figure 3:
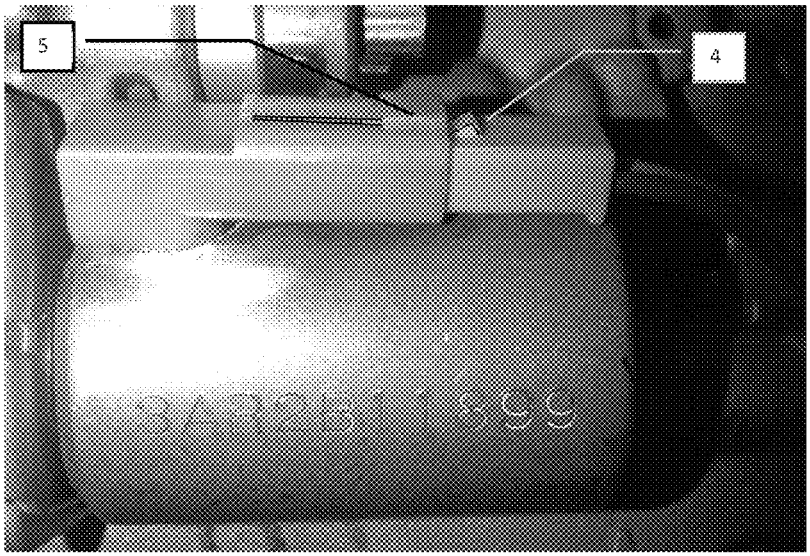
FIG. 3 is a photograph showing a typical connection between linear pressure solenoid and wiring harness before engagement.
Figure 4:
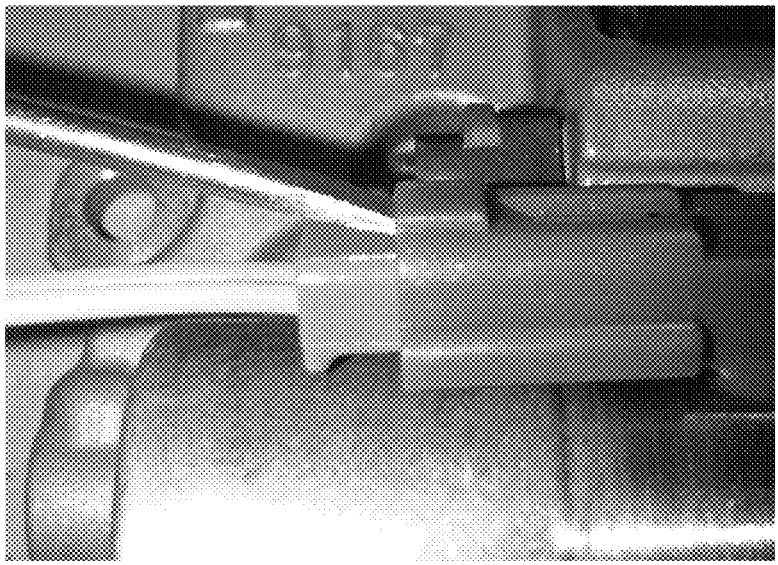
FIG. 4 is a photograph of a typical method to remove plug.
Figure 5:
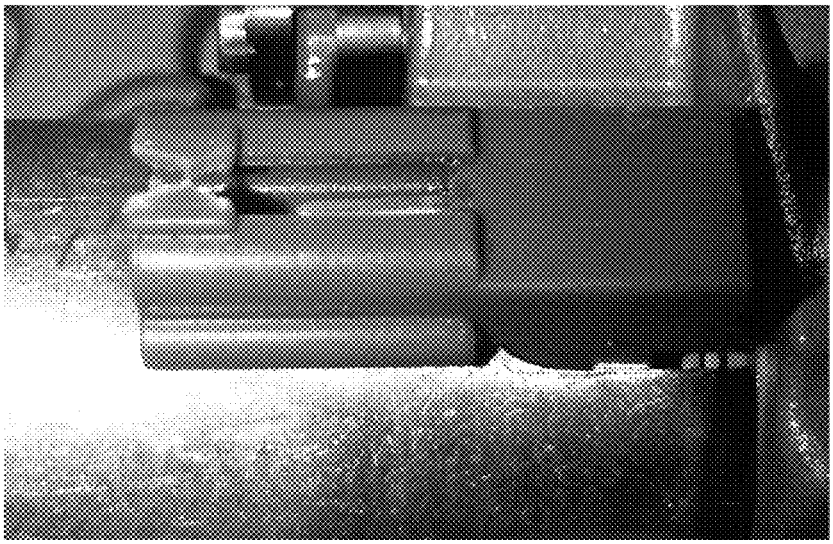
FIG. 5 is a photograph showing a broken bridge after plug removal.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates. At least one embodiment of the present invention will be described and shown, and this application may show and/or describe other embodiments of the present invention. It is understood that any reference to "the invention" is a reference to an embodiment of a family of inventions, with no single embodiment including an apparatus, process, or composition that should be included in all embodiments, unless otherwise stated. Further, although there may be discussion with regards to "advantages" provided by some embodiments of the present invention, it is understood that yet other embodiments may not include those same advantages, or may include yet different advantages. Any advantages described herein are not to be construed as limiting to any of the claims. The usage of words indicating preference, such as "preferably," refers to features and aspects that are present in at least one embodiment, but which are optional for some embodiments.

The use of an N-series prefix for an element number (NXX.XX) refers to an element that is the same as the non-prefixed element (XX.XX), except as shown and described. As an example, an element 1020.1 would be the same as element 20.1, except for those different features of element 1020.1 shown and described. Further, common elements and common features of related elements may be drawn in the same manner in different figures, and/or use the same symbology in different figures. As such, it is not necessary to describe the features of 1020.1 and 20.1 that are the same, since these common features are apparent to a person of ordinary skill in the related field of technology. Further, it is understood that the features 1020.1 and 20.1 may be backward compatible, such that a feature (NXX.XX) may include features compatible with other various embodiments (MXX.XX), as would be understood by those of ordinary skill in the art. This description convention also applies to the use of prime (′), double prime (″), and triple prime (‴) suffixed element numbers. Therefore, it is not necessary to describe the features of 20.1, 20.1′, 20.1″, and 20.1‴ that are the same, since these common features are apparent to persons of ordinary skill in the related field of technology.

Although various specific quantities (spatial dimensions, temperatures, pressures, times, force, resistance, current, voltage, concentrations, wavelengths, frequencies, heat transfer coefficients, dimensionless parameters, etc.) may be stated herein, such specific quantities are presented as examples only, and further, unless otherwise explicitly noted, are approximate values, and should be considered as if the word "about" prefaced each quantity. Further, with discussion pertaining to a specific composition of matter, that description is by example only, and does not limit the applicability of other species of that composition, nor does it limit the applicability of other compositions unrelated to the cited composition.

Various embodiments of the present invention pertain to spring-action retaining clips that fit closely around the external shape of an assembled electrical connector. Preferably, the clips are substantially open on one side, such that the clip can be installed on a preassembled multipiece electrical connector.

In some embodiments, a retaining clip provides overall compression along the length of the mated male and female connector parts. Preferably, such embodiments further include one or more lateral side walls that limit any relative side-to-side motion of the connector assembly relative to the clip.

Yet other embodiments pertain to a clip that clamps laterally around one or both pieces of the multipiece connector, and which further includes downwardly depending end walls that limit any axial relative motion between the connector and the installed clip to the amount of looseness or play between the connector assembly and the installed clip.

Some embodiments include one or more tabs or slots useful for reducing the axial or lateral clamping of the clip on the connector. When so loosened with a tool, the expanded clip (expanded either laterally and/or axially) can be removed, thus permitting disengagement of the pieces of the multipiece connector assembly. What will be shown and described herein are clips having a body with an internal shape that is complementary to the external shape of the assembled multipiece connector. With such a complementary shape, various portions of the clip will correspond to various features of the assembled connector, as will be shown and described. However, it understood that having such a complementary shape generally refers to some features of the shape of the assembled connector, but not necessarily to all features of the external shape of the assembled connector.

Figure 6:
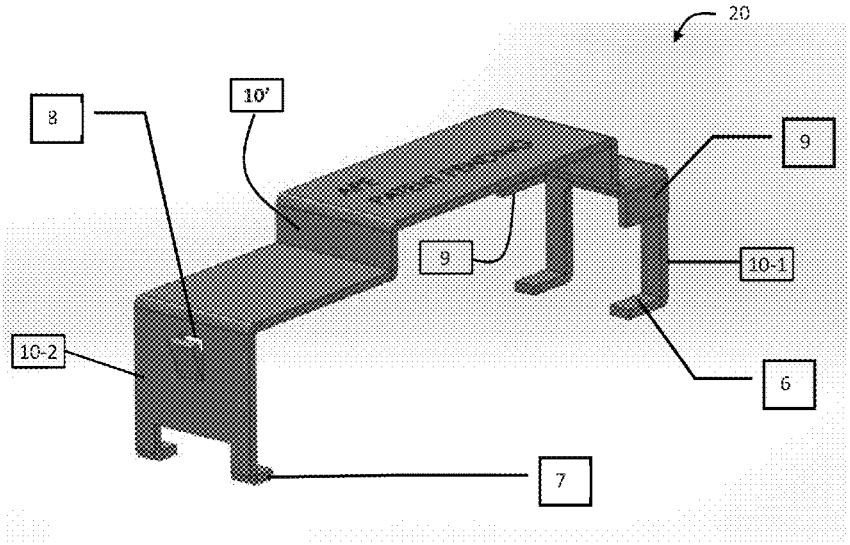
FIG. 6 is a CAD drawing of one embodiment of a retaining clip.
Figure 7:
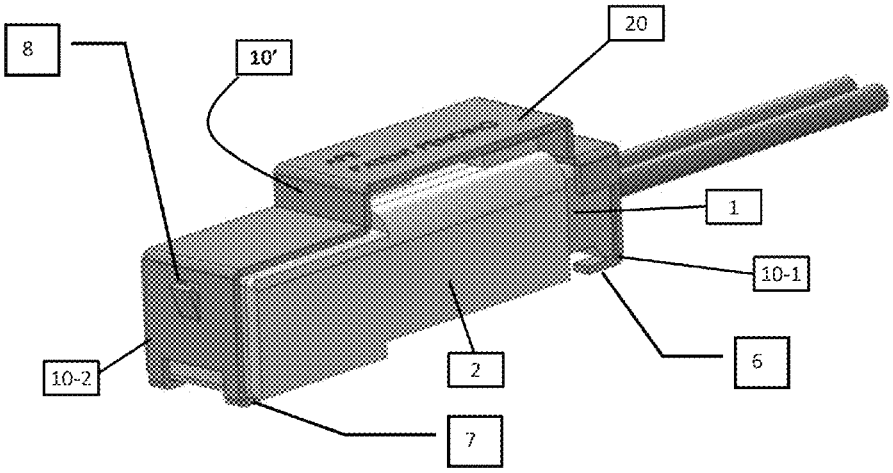
FIG. 7 is a CAD drawing of a front view of the retaining clip of FIG. 6 shown installed on an AW 55-50 linear pressure solenoid connector.
Figure 8:
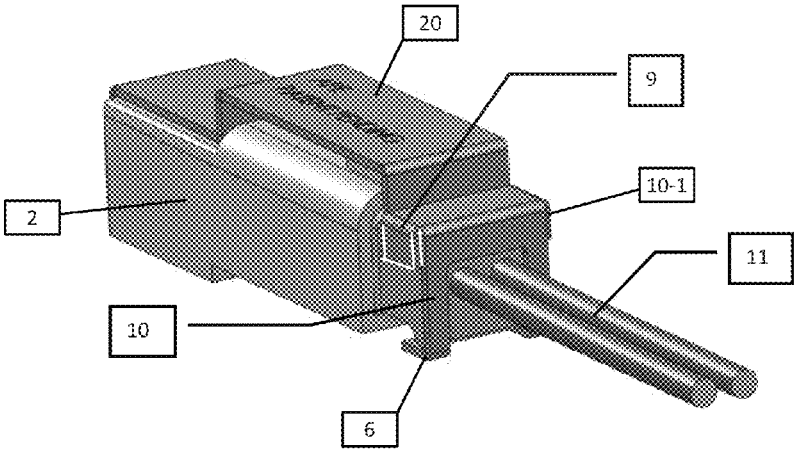
FIG. 8 is a CAD drawing of the back view of the apparatus of FIG. 7.

The apparatus according to one embodiment of the present invention comprises of a thin metal spring clip formed in such a manner that the positive locking feature is maintained; yet it can be removed easily and reused according to the preferred method. One embodiment is shown in FIGS. 6-8. The embodiment is designed for the AW 55-50 linear pressure solenoid, but can be adapted to other configurations as well.

Figure 9:
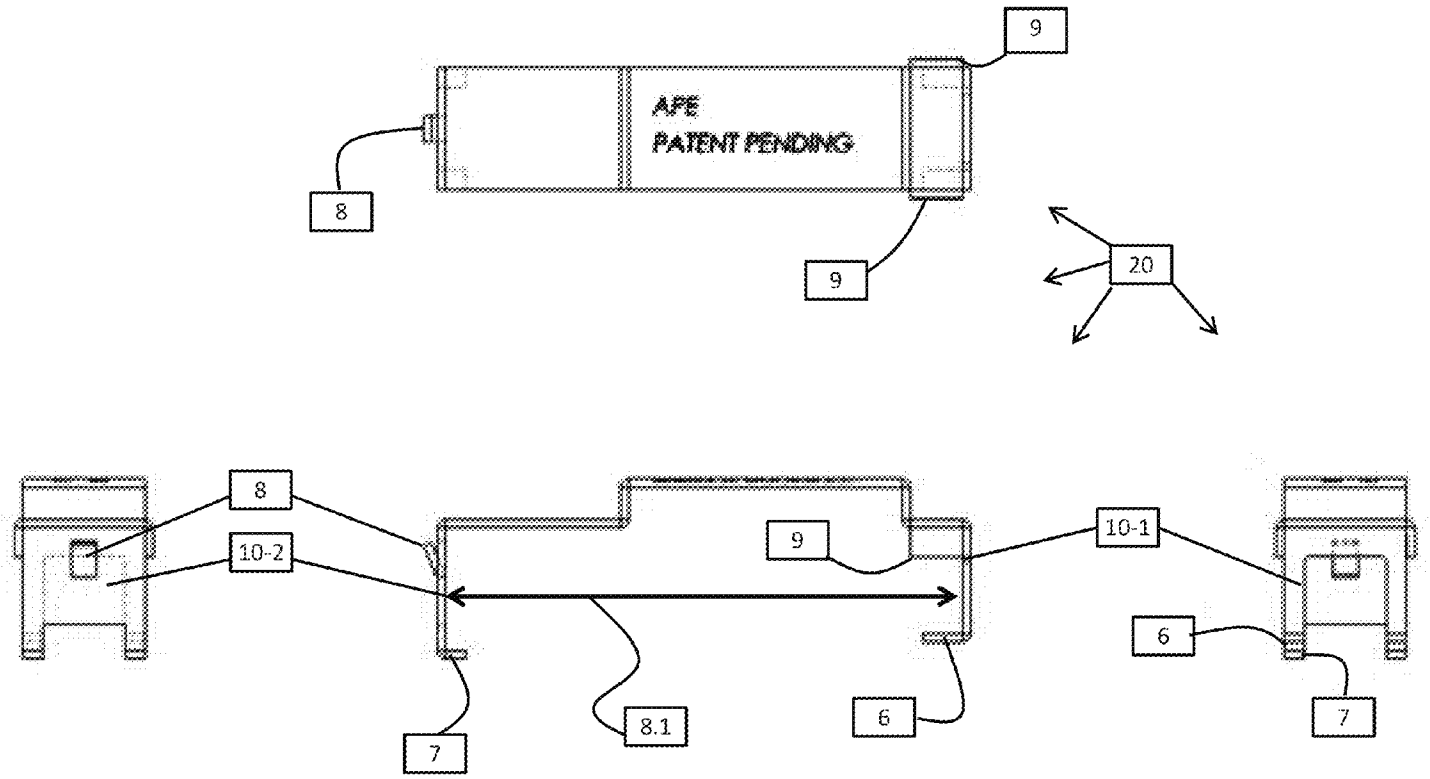
FIG. 9 shows four orthogonally arranged views of a connector according to one embodiment of the present invention.

Referring to FIGS. 6-8, the reusable retaining clip 20 includes several features. First, the clip includes ears (or protruding fingers) 6 and 7 that slide under the plug 1 and the connector 2 on the opposing end. Retaining clip 20 includes walls 10-1 and 10-2 that capture between them the respective outer faces of the assembled plug 1 and connector 2, respectively. Referring to FIG. 9, it can been seen that the free (unassembled) inner distance 8.1 between inner faces of walls 10-1 and 10-2 is adapted and configured to provide a snug level of compressive fit around plug 1 and connector 2, and in yet other embodiments the distance 8.1 is adapted and configured to be a slightly loose fit around plug 1 and connector 2. In still further embodiments, end walls 10-1 or 10-2 can be adapted and configured to provide this snug fit by placing a slight convergent angle on one or both of the two end walls, such that they would converge at a point on the open side of the clip. In this manner, the unassembled inner distance 8.1 is a first, lesser distance proximate to the ears, and a slightly greater distance along the top (closed) side of the retaining clip.

In some embodiments, retaining clip 20 is sufficiently elastic so that retaining clip 20 can be bent as it is being attached to the connection of plug 1 and retaining clip 20. Likewise, retaining clip 20 can be removed by outwardly bending face 10-2 to relieve the snug compressive fit on the assembled connector, as well as to rotate ears 7 from the underneath side of connector 2. There is a protruding tab (a retaining feature) (8) that allows a tool to be inserted. The tool can be levered to flex the clip in such a manner that the ears 7 on one end are lifted out from under the connector. The tab 8 allows the clip to be installed and removed multiple times with ease. The ears 7 on either end of the clip 20 provide lift-off retention of the retaining clip 20 on the assembled connector. Yet other embodiments include a retaining feature comprising a slot or aperture defined in a side wall of the clip that also permits insertion of a tool for a prying removal of the clip from the assembled connector.

There is a centering feature 9 on the plug end that centers and aligns the legs 10-1 around the wires 11 of the plug 1. This centering feature 9 extends downwardly from the top wall of the body of retaining clip 20, and contacts a corresponding external sidewall of the connector, and thus provides alignment and centering of the body of clip 20 in a direction generally orthogonal to the direction of the assembly of connecter parts plug 1 and connector 2 (the direction of assembly being generally coaxial with the depiction of the wires 11 in FIGS. 7 and 8). As best seen in FIG. 8, the side wall 10 of clip 20 extends downwardly in a general U-shape, with the legs of the U extending on either side of wires 11. This prevents incorrect installation where the edges of the legs 10 could touch the wires 11. The overall assembled shape of plug 1 and connector 2 is captured between the internal faces of side walls 10-1 and 10-2, which in some embodiments is a capturing that applies axial compression to plug 1 and connector 2. In still further embodiments, the wrap around fingers 6 and 7 positively capture plug 1 and connector 2, respectively, and further positively retains clip 20 on the assembly of plug 1 and connector 2, such that clip 20 cannot be removed without bending the clip to eliminate contact between fingers 6 and 7 with the underside of plug 1 and connector 2.

Retaining clip 20 further includes an end wall 10-2 that extends generally around the outer surface of connector 2, and which further includes ears 7 that wrap around the front edge of connector 2. In some embodiments, connector 20 includes one or more end walls 10 that depend downwardly from the top wall, and which prevent or limit (by interference) the axial or longitudinal movement of the assembled plug or connector relative to the clip. Any such relative motion is limited to the clearance or play between the ends of the assembled connector and plug and the inner faces of the one or more end walls.

Further, it is recognized that such limits on relative axial motion can also be provided in some embodiments by either of the two downwardly depending, intermediate end wall 10' (best seen in FIGS. 6 and 7), which makes use of an axially-oriented face of connector 2. A similar such intermediate axial face may also be found on some versions of plug 1, in which case a corresponding end wall may be located on the clip.

Another feature of the reusable clip (for cases such as the AW 55-50) is that the positive securing of the connection does not depend on any of the existing locking features. Therefore, the reusable clip can be used in place of the existing locking features if they are broken.

Clip 20 can be attached to the mated assembly of plug 1 and connector 2, but in some embodiments is installed on the unconnected pair of the plug and the connector, by spreading apart (such as by bending) and expanding clip 20. In particular, end walls 10 and their accompanying ears/fingers bend apart during preassembly alignment of the plug and connector. However, once the plug is fully inserted into the connector, clip 20 relaxes back toward its free state, with the fingers wrapping around corresponding edges of the plug or connector, and the plug and connector being held together in a state of compression in some embodiments, whereas in other embodiments the plug and connector are loosely held together between the relaxed end walls and relaxed fingers. It is appreciated that in some embodiments the connector axial length is adapted and configured such that the fully installed distance between end walls 10 is greater than the free state distance, such that the installed clip 20 is in a state of bending and tension.

The material for the reusable clip is any spring metal; however, a heat treated stainless steel or heat treated high carbon steel is preferred. The thickness of the reusable clip is about 0.020 inches. However, other configurations of material and thickness are expected to yield acceptable results as well. However, yet other embodiments of the present invention contemplate the use of any type of material that is suitable for the temperature and vibratory environment of the connector, including plastics.

FIGS. 10-14 present various views of a retaining clip 120 according to another embodiment of the present invention. Clip 20 is similar in some aspects to clip 120, as will be observable to a person having ordinary skill in this art. One difference between clips 20 and 120, for specific embodiments described herein, is that clip 120 clamps laterally around either plug 1 or connector 2, whereas clip 20 clamps axially to the assembly of plug 1 and connector 2. In some embodiments, clip 120 can be attached to an existing assembly of plug 1 within connector 2, such that any potential separation of the plug from the connector is limited by the end walls of the clip. In yet other embodiments, clip 120 does not clamp to the connector, but instead defines a volumetric space equal to or greater than the volumetric space of the corresponding portions of the mated connector pieces, such that there can be some relative lateral and longitudinal movement of the clip relative to the connector pieces, but not so much movement as to permit disengagement of the two connector pieces.

Figure 12:
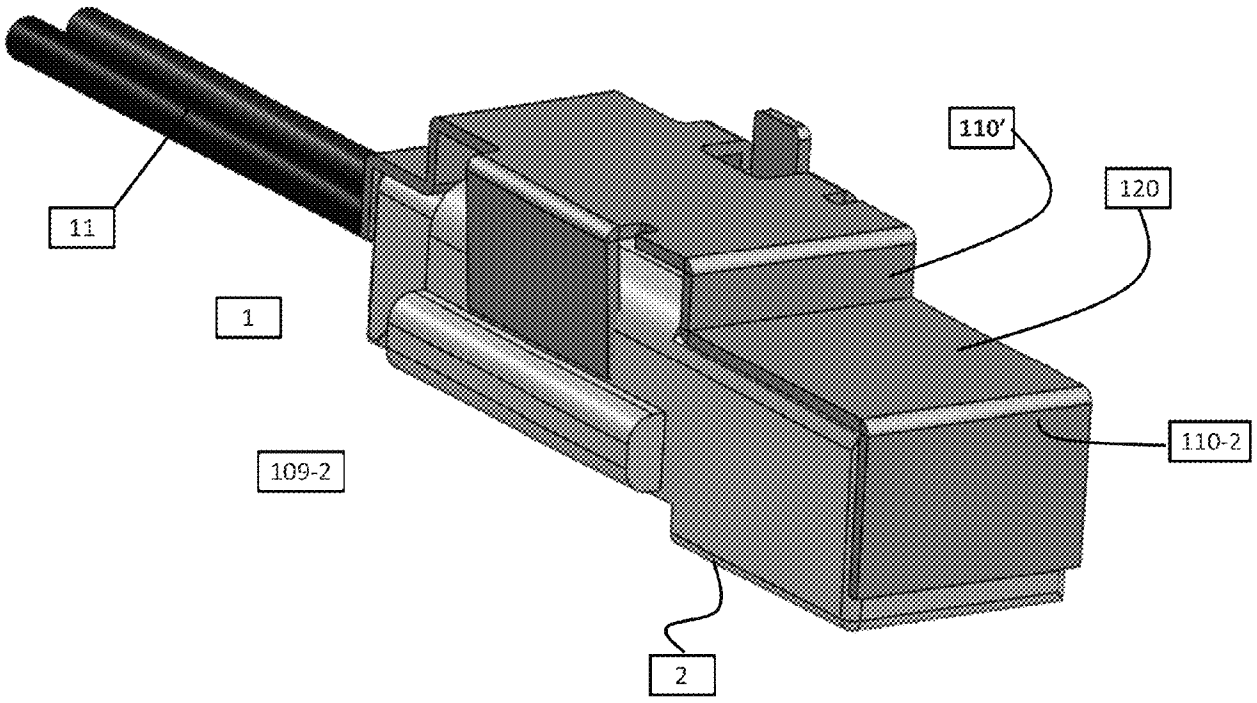
FIG. 12 is a rear, top, right side perspective CAD representation of the retaining clip and connector of FIG. 10.
Figure 13A:
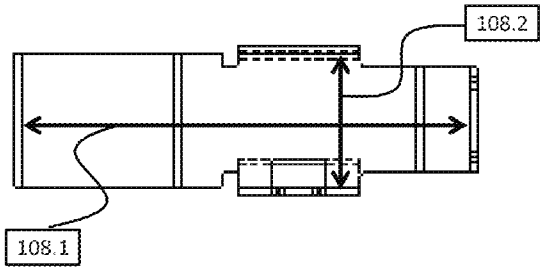
FIG. 13 shows four orthogonal views of a retaining clip according to another embodiment of the present invention: (A) top plan view; (B) rear view; (C) side view; (D) front view.
Figure 13D:
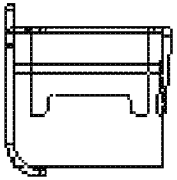
Figure 13C:
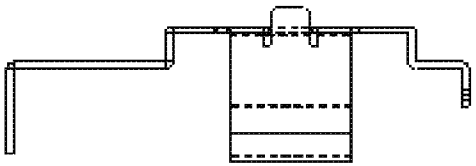
Figure 13B:
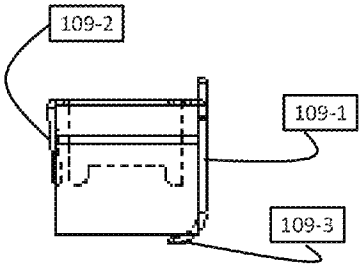

Retaining clip 120 includes a pair of side walls 110-1 and 110-2 that hold between them the assembly of a plug 1 within a connector 2. In some embodiments, end wall 110-1 includes a pair of legs 110 that extend downward in a U-shape around the wires 11 that fit within plug 1. Referring to FIG. 12, end wall 110-2 extends downward around a portion of a sidewall of connector 2. In some embodiments, neither end walls 110-1 or 110-2 include ears that wrap around the end faces of the plug or connector, respectively. In such embodiments, the end features (axial features) of retaining clip 120 provide abutments that prevent lengthwise sliding of the retaining clip relative to the assembly of plug 1 with connector 2, but which may not provide lift-off retention of retaining clip 120 on the connector assembly.

Figure 10:
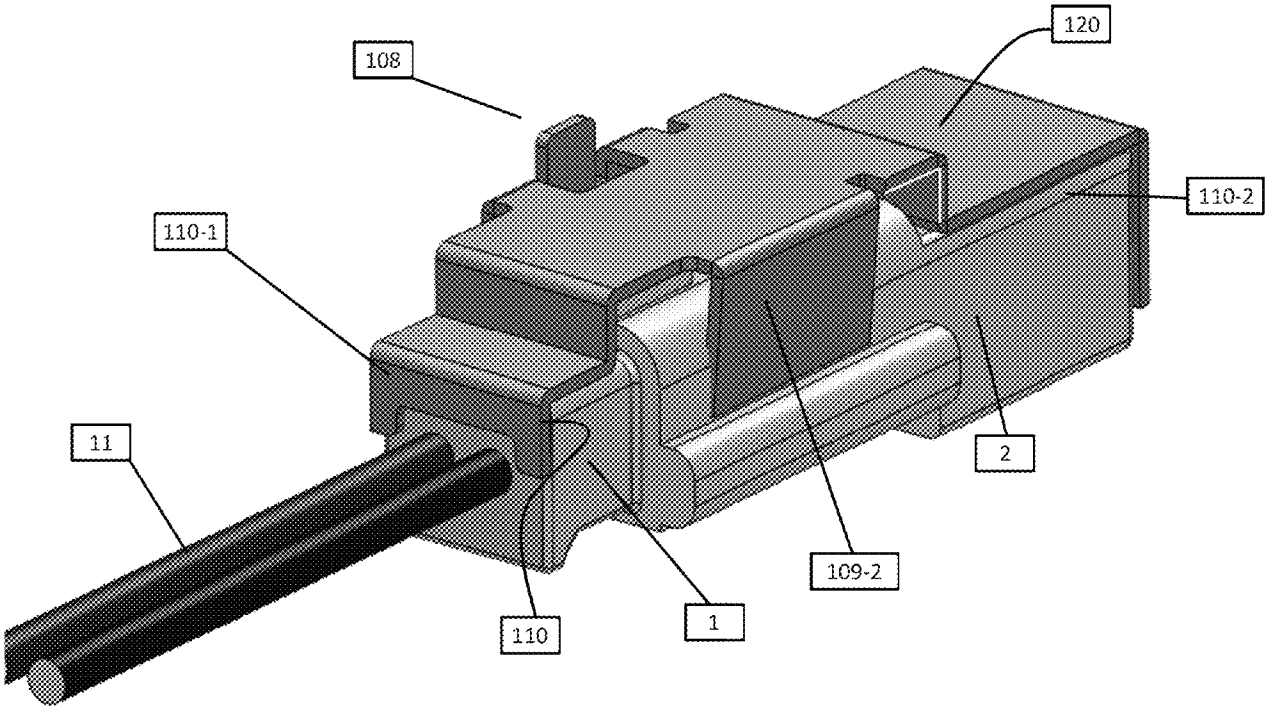
FIG. 10 is a front, top right side perspective CAD representation of a retaining clip according to another embodiment of the present invention as installed on a connector.
Figure 11:
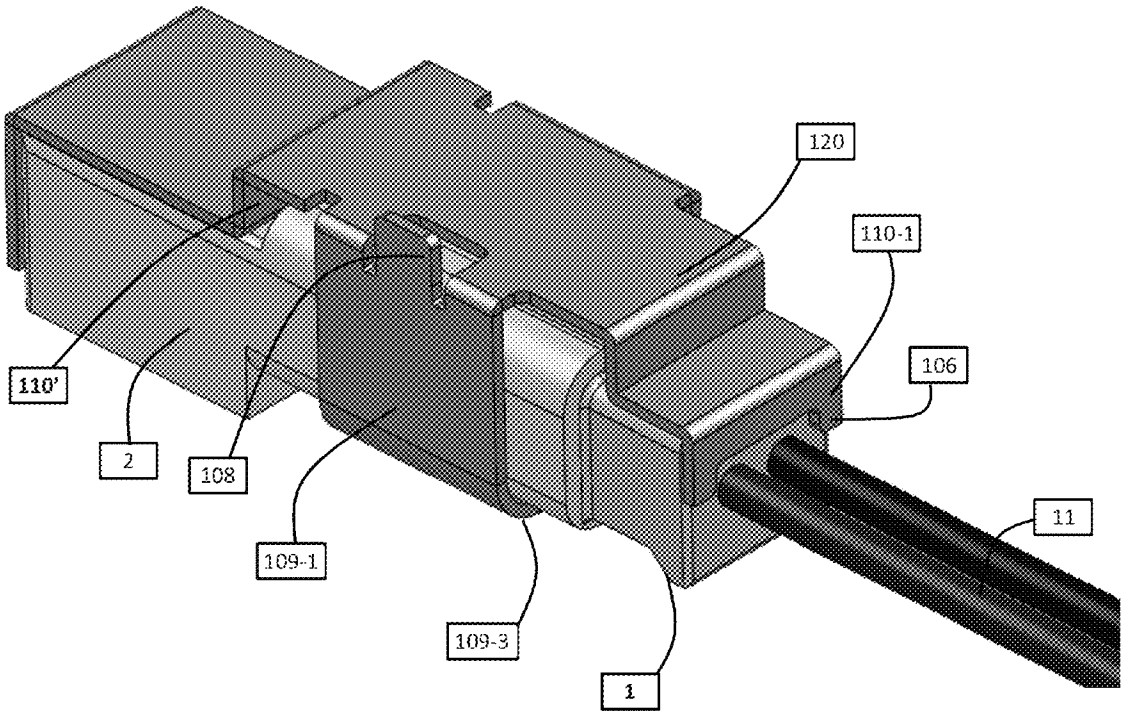
FIG. 11 is a front, top, left side perspective representation of the retaining clip and connector of FIG. 10.
Figure 14A:
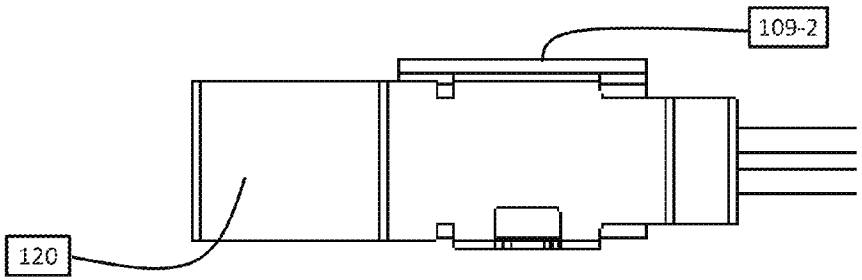
FIG. 14 shows four orthogonal views of the retaining clip of FIG. 13 shown assembled over male and female connectors: (A) top view; (B) rear view; (C); side view; (D) front view.
FIG. 14E is a cross sectional representation of the assembly of FIG. 14C as taken along line A-A.
Figure 14C:
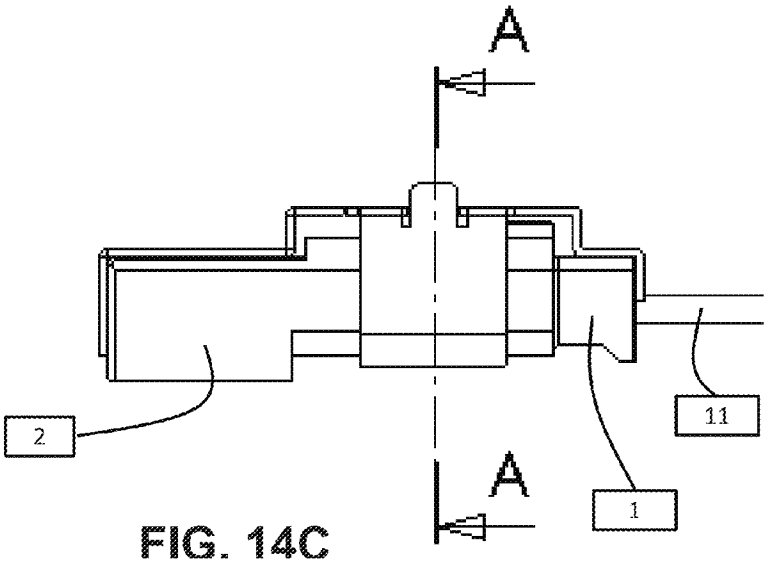
Figure 14B:
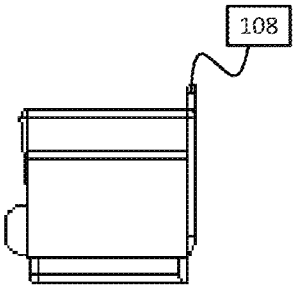
Figure 14E:
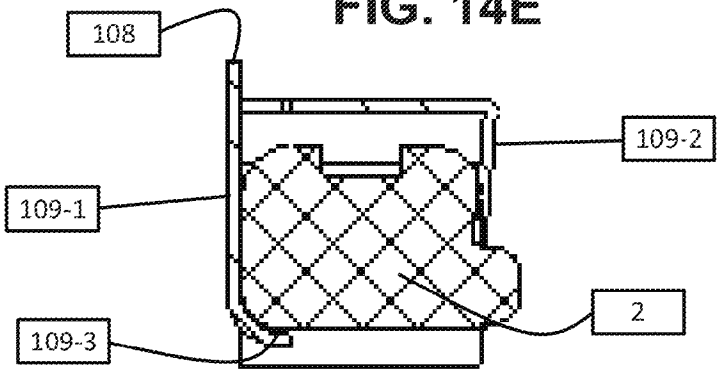
Figure 14D:
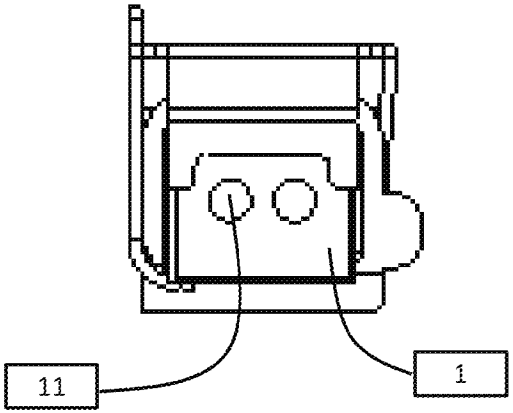

Referring to FIGS. 11 and 12, it can be seen that retaining clip 120 includes a centering feature 109 that preferably provides a combination of lift-off retention, as well as lateral retention. Referring to FIGS. 10 and 11, centering feature 109 includes a pair of opposing lateral side walls 109-1 and 109-2 that extend vertically across lateral faces of the corresponding sidewalls of connector 2. FIG. 12 shows that lateral side wall 109-2 extends at least partway vertically down an external lateral face of the sidewall of connector 2. Referring to FIGS. 11 and 14E, it can be seen that lateral wall 109-1 preferably extends the entire vertical height of connector 2, and preferably includes an ear 109-3 that wraps around the bottommost edge of connector 2, and extends a short distance across the bottom face of connector 2.

Lateral wall 109-1 preferably includes a removal feature or tab 108 that is adapted and configured to be actuated by common tools. Referring to FIGS. 12 and 14E, it can be seen that compression can be applied by pliers across the outer face of tab 108 and the top edge of lateral wall 109-2. In so doing, lateral wall 109-1 can be bent outwardly (referring to FIG. 14E) such that ear 109-3 no longer engages the bottom of connector 2. Therefore, simple pliers can be used to momentarily compress tab 108 and remove clip 120 from the assembled connector. Also, a screwdriver can be inserted in the pocket shown in FIG. 14A and pressure applied against wall 108 to release the ear 109-3.

Various aspects of different embodiments of the present invention are expressed in paragraphs X1, X2, X3, X4, and X5 as follows:

X1. One aspect of the present invention pertains to an apparatus for an assembled multipiece electrical connector. The apparatus preferably includes a one piece body having a top wall and at least one, downwardly depending side wall. The side wall being elastically movable in a direction from a free state to an expanded state, the distance in the direction between the inner face of the body side wall and the inner face of an opposing vertical surface of the body in the free state being about the same or less than the corresponding external distance between opposing external features of the assembled connector. The body including a removal feature useful for elastically expanding said side walls for removal of the installed clip. The apparatus preferably includes wherein said top wall and said side walls define a substantially open interior having a shape generally complementary to the external shape of portions of the assembled electrical connector.

X2. Another aspect of the present invention pertains to a method for repairing an automatic transmission that includes a used solenoid assembly having a first electrical connector mateable with a second electrical connector. The method preferably includes placing a clip over the mated first connector and second connector. The method preferably includes compressing together the mated first connector and second connector with the secured clip.

X3. Yet another aspect of the present invention pertains to an apparatus for an assembled multipiece electrical connector including a body having a top wall, a pair of lateral walls extending from opposite lateral sides of said top wall, and a pair of end walls extending from said top wall. The lateral walls are elastically expandable in a lateral direction from a free state to an installed state, and configured to fit across opposing external sides of the assembled connector in the installed state. The end walls are adapted and configured to limit end to end movement of the assembled connector relative to said body when installed.

X4. Still another aspect of the present invention pertains to a method for securing together a first electrical connector mateable with the second electrical connector of an electrical wiring harness with a retaining clip. The method preferably includes placing the clip over the unmated first connector and second connector, and then mating the first connector and second connector having the placed clip. The method preferably includes securing the placed clip to the mated first connector and second connector, compressing together the mated first connector and second connector with the secured clip.

X5. Another aspect of the present invention pertains to a method for repairing an automatic transmission. The method preferably includes providing a used solenoid assembly having a first electrical connector mateable with the second electrical connector of an electrical wiring harness, and a retaining clip. The method preferably includes placing the clip over the unmated first connector and second connector. The method preferably includes mating the first connector and second connector having the placed clip. The method preferably includes securing the placed clip to the mated first connector and second connector. The method preferably includes compressing together the mated first connector and second connector with the secured clip.

Yet other embodiments pertain to any of the previous statements X1, X2, X3, X4 or X5 which are combined with one or more of the following other aspects:

Wherein the body side walls are first body side walls and the direction is a first direction, and which further comprises a pair of second body sides walls downwardly extending from said top wall in a second direction orthogonal to said first direction.

Wherein separate pieces of the multipiece connector are assembled together in the direction.

Wherein the direction is a first direction and the separate pieces of the multipiece connector are assembled together in a second direction orthogonal to the first direction.

Wherein the underside of said top wall and said wherein said body can be expanded and lifted off of the assembled connector.

Wherein the body further including a pair of opposing, downwardly depending lateral walls, and the minimum distance between the inner face of said lateral walls being substantially the same or less than the external distance across the lateral sides of the connector.

Wherein one of the body end walls including an opening for receiving therein the wires of the connector, Wherein the body is a thin-walled structure fabricated from sheet metal or molded from plastic.

Wherein the electrical connector is a connector used with an automatic transmission.

Wherein the inner surface of at least one of the body side walls has a height about the same as the external height of the corresponding connector sidewall, and said at least one body side wall includes a finger that wraps around a corner of the connector side wall.

Wherein the distance between the inner faces of the body side walls has a minimum distance, the minimum distance being less than the external distance between opposing sidewalls of the connector.

Wherein the body end walls are substantially parallel.

Wherein the body side walls are non-parallel, and the body side walls compress the connector when the body is placed over the connector.

Wherein the removal feature is an outwardly extending tab adapted and configured for use to expand said body during removal or installation.

Wherein the removal feature is slot in the body adapted and configured for insertion of a tool to expand said body during removal or installation.

Which further comprises expanding the retaining clip prior to said placing.

Wherein the expanding is with a tool is by fingers of a users' hand.

Which further comprises releasing the expanded clip after said placing.

Which further comprises mating the first connector and second connection in a direction before said placing, wherein said compressing is along the direction of mating.

Which further comprises compressing one of the first connector or second connector in a second direction orthogonal to the one direction.

Wherein one of the side walls or one of the end walls of the clip is elastically bent out of the way to permit placement of the clip over the assembled multipiece connector, but after installation the clip provides relative clearance in the longitudinal and/or lateral directions, but not so much motion as to permit disengagement of the multiple pieces of the connector from one another.

Wherein the clip compresses the two pieces of the electrical connector, or prevents the two parts from separating, or limits the separation of the female connector from the male connector.

Wherein the clip is biased to stay coupled to the connector.

Wherein the clip does not define an enclosed volume.

Wherein the connectors have a generally rectangular outer shape.

Wherein the clip includes a tab or aperture to expand the length, or a tab or aperture to expand the width.

Wherein the clip includes means for expanding the free state of the clip body, including a tab, feature, slot, or aperture, usable by pliers, a screwdriver, or fingers.

While the inventions have been illustrated and described in detail in the drawings and foregoing description, the same is to be considered as illustrative and not restrictive in character, it being understood that only certain embodiments have been shown and described and that all changes and modifications that come within the spirit of the invention are desired to be protected.

What is claimed is:

1. An apparatus for an assembled multipiece electrical connector, comprising:

a one piece body having a top wall and a pair of opposing, downwardly depending side walls, said body being fabricated from a resilient material, said side walls being elastically expandable in a first direction from a free state to an expanded state, the distance in the first direction between the inner faces of the body side walls in the free state being about the same as the corresponding external distance in the first direction between opposing external sides of the assembled connector, said body including a removal feature having an aperture configured to receive a tool therein and thereby useful for elastically expanding said side walls in the first direction;

wherein said to wall and said side walls define a substantially open interior having a shape generally complementary to the external shape of portions of the assembled electrical connector; and wherein said body side walls are first body side walls, and which further comprises a pair of second body side walls downwardly extending from said top wall in a second direction orthogonal to said first direction.

2. The apparatus of claim 1 wherein separate pieces of the multipiece connector are assembled together in the first direction.

3. The apparatus of claim 1 wherein the separate pieces of the multipiece connector are assembled together in the second direction.

4. The apparatus of claim 1 wherein said body can be expanded and lifted off of the assembled connector.

5. The apparatus of claim 1 wherein the electrical connector is a solenoid connector for an automatic transmission.

6. The apparatus of claim 1 wherein the inner surface of at least one of the body side walls has a height about the same as the external height of the corresponding connector sidewall, and said at least one body side wall includes a finger that wraps around a corner of the connector side wall.

7. The apparatus of claim 1 wherein the distance between the inner faces of the body side walls has a minimum distance, the minimum distance being less than the external distance between opposing sidewalls of the connector.

8. The apparatus of claim 1 wherein the body side walls are substantially parallel.

9. The apparatus of claim 1 wherein the body side walls are non-parallel, and the body side walls compress the connector when the body is placed over the connector.

10. The apparatus of claim 1 wherein said removal feature is an outwardly extending tab adapted and configured for use to expand said body during removal or installation.

11. The apparatus of claim 1 wherein said aperture is a slot in the body adapted and configured for insertion of said tool to expand said body during removal or installation.

12. An apparatus for an assembled multipiece electrical connector, comprising a one piece body having:

a top wall, a pair of lateral walls each downwardly depending from opposite lateral sides of said top wall, and a pair of end walls each downwardly depending from said top wall, said body being fabricated from a resilient material, said lateral walls being elastically expandable in a lateral direction from a free state to an installed state, the minimum distance in the lateral direction between the inner faces of the body lateral walls in the free state being adapted and configured to clamp on opposing external sides of the assembled connector in the installed state, a height of the end walls being adapted and configured to limit end to end movement of the assembled connector relative to said body when installed;

wherein said top wall and said side walls define a substantially open interior that permits installation of a separated said body onto an assembled connector.

13. The apparatus of claim 12 which further comprises a removal feature for elastically expanding apart the lateral walls or the end walls.

14. The apparatus of claim 13 wherein said removal features is an outwardly extending tab adapted and configured for use of a tool to expand said body during removal or installation.

15. The apparatus of claim 12 wherein one of said side walls or one of said end walls includes a protruding feature that prevents installation of said body onto an assembled connector, and which further comprises means for expanding the one wall such that said expanded body can be installed onto an assembled connector.

16. The apparatus of claim 12 wherein at least one of said side walls or said end walls includes a finger that wraps around a corresponding corner of the assembled connector.

* * * * *